United States Patent [19]

Mittelmann

[11] 4,078,595

[45] Mar. 14, 1978

[54] COMBINATION HANDBAG AND SHOPPING BAG

[76] Inventor: Gabriel Mittelmann, 96-22 67th Ave., Rego Park, N.Y. 11374

[21] Appl. No.: 797,463

[22] Filed: May 16, 1977

[51] Int. Cl.[2] ..... A45C 3/06

[52] U.S. Cl. ..... 150/30; 150/1.7; 190/44

[58] Field of Search ..... 150/1.7, 30, 35; 190/44

[56] References Cited

U.S. PATENT DOCUMENTS

| | | | |
|---|---|---|---|
| 2,078,624 | 4/1937 | Wolff | 150/1.7 |
| 2,729,257 | 1/1956 | Kepper | 150/1.7 |

*Primary Examiner*—Donald F. Norton

*Attorney, Agent, or Firm*—Friedman, Goodman, & Teitelbaum

[57] ABSTRACT

A carrying case which serves as a handbag having a compartment for retaining normal handbag materials, and which includes a second compartment which is expanded and can be used as a shopping bag. A movable dividing wall serves to selectively close off each compartment so that a common access of the carrying case is utilized for each of the two compartments.

10 Claims, 7 Drawing Figures

COMBINATION HANDBAG AND SHOPPING BAG

BACKGROUND OF THE INVENTION

This invention relates to a carrying case and more particularly to a combination handbag and shopping bag.

Carrying cases having expandable capabilities for use in both normal purse requirements as well as shopping bag requirements, are well known. However, most such prior art carrying cases have severe limitations in that they either do not provide separate compartments for the two functions, or, where separate compartments are provided, they do not have a common access for the two compartments.

For example, U.S. Pat. No. 2,412,007 describes one combined hand and shopping bag having a large size bag which is folded over along its substantial midpoint to form a second compartment within the folded over section. The second compartment, which is approximately one half the size of the bag itself, is utilized as the handbag. When the shopping bag use is desired, the bag is opened up and entry into the bag is available. However, with this arrangement, when the bag is opened up to its full length, the first compartment is completely eliminated, consequently all items retained therein must be removed before utilizing the shopping bag.

A similar arrangement is described in U.S. Pat. Nos. 2,479,824 and 3,164,187. In both references, the smaller handbag compartment is no longer existing when the bag is opened up to make the shopping bag available. As a result, although the carrying case can be utilized for such two purposes, they cannot be utilized simultaneously as both a handbag and shopping bag, but only alternate usage of these two functions is available.

A different type of combination handbag and shopping bag is provided in U.S. Pat. No. 3,989,080. In this patent, there are effectively two separate compartments which are interconnected. A first of these compartments is collapsible and can be folded into a storage position against a side wall of the second compartment. A cover or flap connected to the second compartment can be utilized to enclose the folded first compartment when in its stored position. However, in this patent there are actually two separate compartments each with its own access. As a result, when the first compartment is expanded, the carrying case looks, acts, and in all ways constitutes two separate independent carrying cases which are merely interconnected. This provides an awkward and unaesthetic type of carrying case.

SUMMARY OF THE INVENTION

It is accordingly an object of the present invention to provide a carrying case which combines a handbag and a shopping bag.

A further object of the present invention is to provide a carrying case which utilizes a common access opening which can selectively be used either to enter the shopping bag or the hangbag.

Another object of the present invention is to provide a bag which contains a first compartment for use as a handbag, and wherein the bag can be operated to extract an expandable second compartment for use as a shopping bag.

Yet another object of the present invention is to provide a carrying case containing a pouch which can be collapsed and retained within the carrying case.

Still a further object of the present invention is to provide a carrying case having a first compartment of a depth substantially the same as the carrying case, and having a closable access through which a second compartment extends, the second compartment having a greater depth than the carrying case.

A further object of the present invention is to provide a carrying case having a pouch which extends beneath the carrying case and which matches the carrying case in color and design.

Yet another object of the present invention is to provide a carrying case which contains two compartments, one serving as a shopping bag and the other serving as a handbag, and wherein the integrity of the two compartments remain separately identifable.

Still a further object of the present invention is to provide a combined handbag and shopping bag in a single unitary structure, wherein the two bags remain separate and they can simultaneously retain their respective contents.

Briefly, the invention provides a carrying case having a casing with a top and bottom access opening, with at least the bottom access being closable. A pouch is coupled to the inside of the casing in such a manner that the top access opening provides access into the pouch. At least a portion of the pouch is foldable between an expanded position which extends through the bottom access opening, and a compacted position which fits within the confines of the casing and can be retained by closing the bottom access. A divider is coupled within the pouch and divides the carrying case into a first compartment which has a depth approximately equal to the depth of the casing and a second compartment which has the depth of the extended pouch.

The divider is movable between a first and second position. Each of these two positions closes off a respective one of the two compartments. In this manner, access through the top access opening can be restricted to a selected one of the compartments.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing like reference characters designate like parts.

DESCRIPTION OF THE PREFERRED EMBODIMENT

Figure 1:
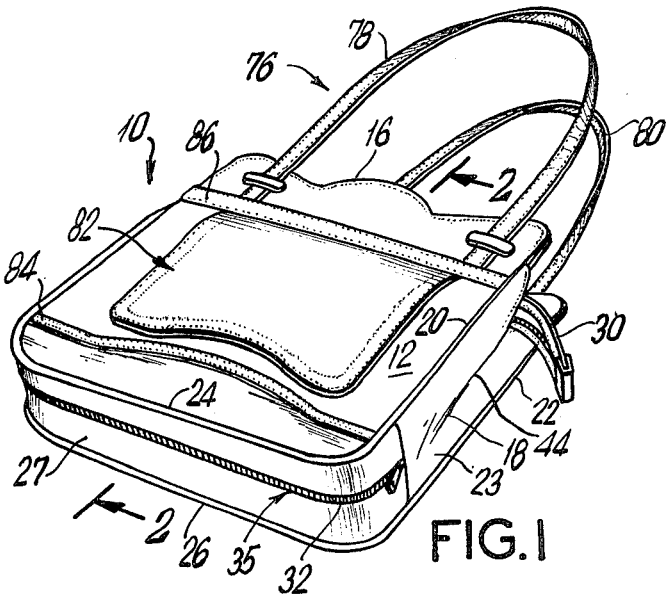
FIG. 1 is a perspective view of the carrying case being utilized as a handbag.

Referring now to the figures, the carrying case includes a casing shown generally at 10 which is formed of a front panel 12 and a rear panel 14. The two panels are shown of substantially the same configuration and are approximate rectangles with curved edges at their bottom portion, and including a decorative scalloped top edge 16. The front and rear panels 12, 14 are interconnected by means of a mid panel 18, which interconnect the side edges 20, 22 of the front and rear panels by the side sections 23, as well as connecting the bottom edges 24, 26 by the bottom section 27. The interconnected edges are formed with a welt or binding which helps support the mid panel and retain it to the front and rear panels.

Figure 6:
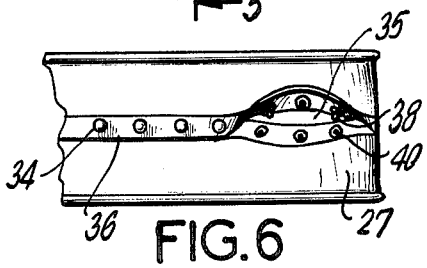
FIG. 6 is a bottom plan view of a bottom section of the carrying case showing an alternative fastening means thereof.
Figure 7:
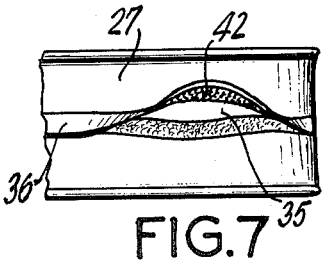
FIG. 7 is a view similar to FIG. 6 and showing yet a further alternative fastening means.

The front and rear panels are interconnected on three of their sides, while the top portion is openable at 28 for providing access into the casing 10. For convenience, a zipper 30 is conventionally attached to the top inner panels 31 and 33, however, other closure or fastening means can also be used to close the access opening at 28. Additionally, an access opening at 35 is provided along the bottom mid panel 27. Fastening or closure means are also provided to close off the bottom access opening at 35. As shown in FIG. 1, the closure or fastening means is the zipper fastener 32. However, other closure or fastening means can be used, as for example, as shown in FIG. 6, wherein snap fasteners 34 are provided along an overlapping seam 36 for closing off the bottom opening at 35. The snap fasteners include a male portion 38 and cooperating female snap portion 40, one portion of which is formed on one overlapping seam and the other formed on the opposing seam. Additionally, as shown in FIG. 7, a Velcro fastener 42 can be applied to the confronting edges of the overlapping seam closing the access opening at 35 formed in the bottom mid panel 27. For convenience, as shown in FIG. 1, the zipper 32 or other such closure or fastener, extends partway up the side portions 23. It should also be noted that the side portions 23 are flexible members so that they can be folded inwardly, as shown along line 44, to permit joining together of the top inner panels 31, 33 by means of the top zipper 30.

Figure 5:
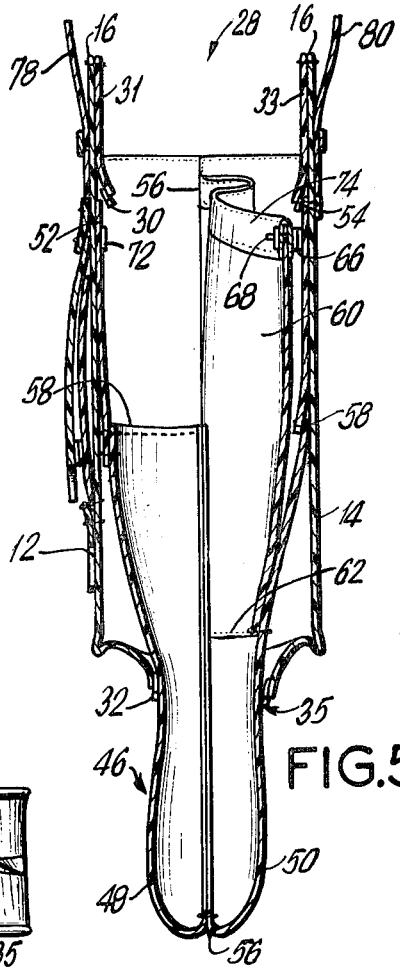
FIG. 5 is a side sectional view taken along lines 5—5 of FIG. 4.

Within the casing 10, there is connected a pouch, shown generally at 46 and best seen in FIG. 5. The pouch includes side walls 48, 50 having their respective upper ends 52, 54 connected to the top portions of the front and rear panels 12 and 14. Conveniently, the same stitching which is utilized to fasten the side walls 48, 50 to the front and rear panels 12, 14 can also be utilized to hold other decorative portions fastened to the outer side of the front and rear panels. The two sides and bottom of each of the side walls 48, 50 are interconnected to each other respectively at 56 by conventional seaming means to form the pouch.

Figure 4:
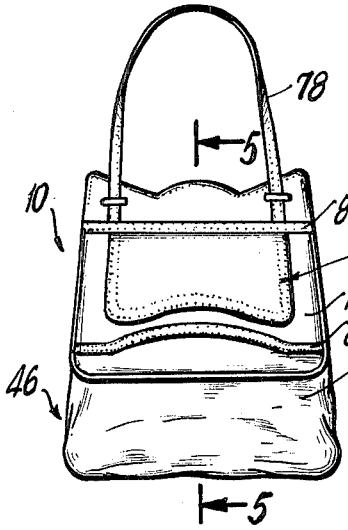
FIG. 4 is a side view of the carrying case being utilized as a shopping bag.

The depth of the pouch is greater than the depth of the casing. This is achieved by making the height of the side walls 48, 50 substantially the same, where the height of these side walls is greater than the height of the front and rear panels 12, 14. As a result, in its expanded position, the pouch 46 can extend through the bottom access opening at 35 in the bottom of the casing and depend downwardly therefrom, as shown in FIGS. 4 and 5.

Figure 2:
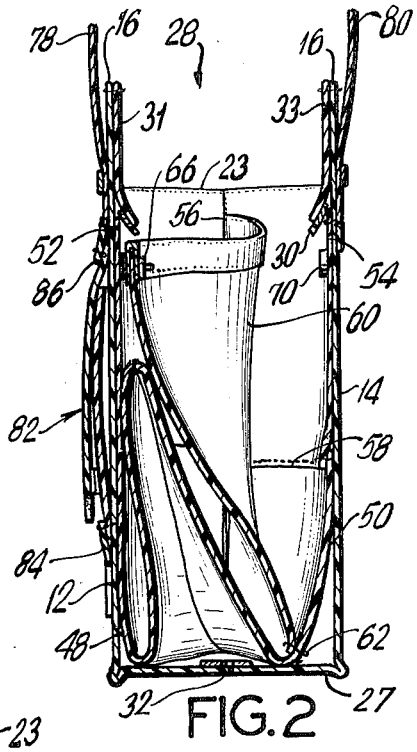
FIG. 2 is a side sectional view taken along line 2—2 of FIG. 1.

The pouch is formed with at least its lower part made of flexible material to thereby permit it to be unfolded to an expanded position, shown in FIG. 5, where it extends through the opening 35, or to be folded into a compacted position, as shown in FIG. 2, where it is folded upwardly and maintained within the confines of the casing and secured by closing the bottom access opening at 35. The side walls 48, 50 of the pouch can each be conveniently made of a continuous piece of material. Alternately, the side walls can each be constructed of two sections with the top and the bottom sections being joined together by the stitching lines or seam 58. The bottom sections are formed of flexible material, while the top sections above the lines or seam 58 are formed of stiffer material serving as an inner lining for the casing. The lower section of the pouch beneath the lines 58 would preferably be made of a material whose exterior surface matches in color and/or texture with the front and rear panels 12, 14 so that when the pouch is in its expanded position extending through the opening at 35, as shown in FIGS. 4 and 5, the depending lower section of the pouch will match the side panels of the casing and will give the appearance of a single unitary shopping bag.

Figure 3:
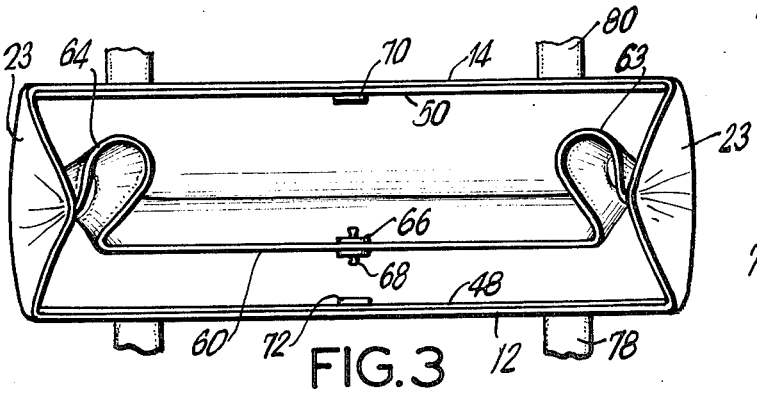
FIG. 3 is a top plan view of the carrying case.

Within the pouch 46, there is a divider comprising a separating wall 60 having side gussets 63, 64, as best shown in FIG. 3 where the zipper 30 is not shown therein for clarity thereof. The side edges of the gussets 63, 64 are joined to the side walls 48, 50 in the seam 56, and are disposed adjacent to the side sections 23 of the mid panel 18. The bottom edge of the separating wall 60 is connected across the side wall 50 by the stitching lines or seam 62, however, it could also have been connected to the other side wall. Because of the availability of the crimped material provided by the side gussets 63, 64, the separating wall 60 can be moved between a first position, wherein it is engaged against the side wall 48 and the front panel 12 adjacent thereto, and a second position, wherein it is engaged against the side wall 50 and the rear panel 14 adjacent thereto. A double sided snap fastener is provided, including opposing male portions 66, 68 centrally disposed on either side of the separating wall 60, and cooperating female portions 70, 72 respectively placed on the side walls 50 and 48. It is understood that the portions 72, 70 can also be used to join the side walls 48, 50 to the front and rear panels 12, 14, respectively, for support thereof. Other suitable means, such as a zipper, a Velcro fastener and the like, can be used if desired and/or necessary in place of the snap fastener.

It will be appreciated that the separating panel 60 effectively divides the pouch into two compartments. The first or handbag compartment, shown on the right side of FIG. 2, is defined between the separating wall 60 and the side wall 50. The stitching lines or seam 62 at the bottom of the separating wall 60 is located approximately at the same depth as the casing 10 whereby the handbag compartment has a depth approximately equal to the depth of the casing itself. In utilizing the handbag compartment, the separating wall 60 is moved towards the front panel 12 and the snap fastener 68 is locked into its mating portion 72.

A second or shopping bag compartment is also formed between the separating wall 60 and the other side wall 48. The depth of this shopping bag compartment will be the full depth of the pouch itself. In utilizing the shopping bag compartment, the separating wall 60 is moved towards the rear panel 14 with the snap fastener 66 being locked into the cooperating portion 70. It should therefore be appreciated, that the same access opening at 28 provided through the top of the casing is utilized to gain entrance into either of the two compartments. It should further be appreciated, that by moving the separating wall 60 between its respective two positions towards either of the front and rear panels 12 and 14, access can be selectively restricted to only one of the two compartments. Furthermore, it should be appreciated that contents can be retained in the handbag compartment and closed off, while access is had to the shopping bag compartment. The contents of the handbag compartment need not be removed to gain access to the shopping bag compartment, and the handbag compartment remains fully and identifiably intact although access is had to the shopping bag compartment.

As shown above, the carrying case can be used either as a handbag or a shopping bag. When used as a handbag, the extended portion of the pouch 46 is compacted and folded up within the casing. Preferably, it is folded on its side within the second compartment, as shown in FIG. 2. The bottom access opening at 35 is closed by any one of the closure or fastening means 32, 34, 42 mentioned above, and the separating wall 60 is moved towards the front panel 12 and secured, whereby access is now available only into the first or handbag compartment on the right hand side. This handbag compartment has a depth approximately equal to the depth of the casing whereby the casing is utilized as a handbag. Access is had through the opening at 28 and normal handbag contents can be stored therein.

It will be appreciated that the shape and style of the casing is made to represent a normal handbag so that in its general use it will only be identifiable as a regular handbag.

When a person is shopping and extra space is needed to carry various additional packages, the carrying case can be converted into a shopping bag. The zipper 32 is opened and the lower portion of the pouch is expanded so that it will depend outwardly from the casing through the opening 35. The separating wall 60 is moved to its opposite side towards the rear wall 14 and secured, whereby it closes off the handbag compartment and permits access only to the shopping bag compartment.

As shown in FIGS. 4 and 5, with the pouch extended, the carrying case will now be a shopping bag having a deeper storage capacity than the handbag. At the same time, it will be recognized that the contents of the first or handbag compartment need not be removed from that first compartment and can be retained therein even though use is made of the second or shopping bag compartment. It should further be noted, as shown in FIG. 4, that the shape of the pouch 46, which depends outwardly from the casing 10, is made to represent a continuation of the casing style and design. As shown, the panels of the casing have a tapering along their sides. This tapering angle is continued into the depending pouch 46 so as to appear as a continuous integral member. By making the material of the same or similar matching type both in color, texture, style and design, the shopping bag, as it appears in FIG. 4, will look as a single unitary structure rather than as a handbag with a depending portion.

As shown in FIGS. 1 and 4, there is also provided a handle 76 for conveniently carrying the combination handbag and shopping bag. The handle is shown formed of first and second straps 78, 80, each respectively connected to one of the front and rear panels 12, 14. However, other types of handles could similarly be utilized. Additionally, a side pocket 82 is formed on the front panel 12 and additional decorative straps 84, 86 are provided for support, decoration, as well as for use in covering various seams and interconnecting sections and panels.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A carrying case comprising:

a casing having first and second access means, at least said second access means being closable;

a pouch secured to an inside portion of said casing, said first access means providing entrance into said pouch, at least a portion of said pouch being unfoldable to an expanded position extending through said second access means and being foldable to a compacted position fitting within confines of said casing; and divider means positioned within said pouch for dividing said pouch into a first compartment having a depth approximately equal to a depth of said casing and a second compartment having a depth of said pouch in said expanded position.

2. A carrying case as in claim 1 and wherein said divider means is movable between first and second positions, each of said first and second positions closing off a respective one of said two compartments, whereby access is restricted to a selected one of said two compartments.

3. A carrying case as in claim 2 and further comprising fastener means for selectively retaining said divider means in one of said first and second positions.

4. A carrying case as in claim 2 and wherein said casing further comprises front and rear panels, a mid panel interconnecting said front and rear panels along their opposing side and bottom edges, said second access means being provided in a bottom portion of said mid panel, and fastening means for selectively closing said second access means.

5. A carrying case as in claim 4 and wherein said pouch further comprises first and second interconnected side walls respectively secured to inner sides of said front and rear panels, a height of said side walls being greater than a height of said front and rear panels, and at least lower portions of each of said side walls being of flexible material.

6. A carrying case as in claim 5 and wherein the lower side wall portions are fabricated of a material substantially matching outer walls of said front and rear panels, whereby in said expanded position, the extending lower portions of said side walls appear integral with said front and rear panels.

7. A carrying case as in claim 5 and wherein said divider means comprises a separating wall, a bottom of said separating wall being connected to an intermediate portion along one of said side walls, and gussets securing said separating wall between side edges of said side walls adjacent to inner side sections of said mid panel, said first compartment being defined by said separating wall and said first side wall, and said second compartment being defined by said separating wall and said second side wall.

8. A carrying case as in claim 7 and further comprising a double sided snap fastener positioned on said separating wall, and mating snap fasteners positioned respectively on an inner side of each of said side walls for engaging said double sided snap fastener.

9. A carrying case as in claim 1 and further comprising handle means coupled to said casing and extending above said first access means, and openable means for closing said first access means.

10. A carrying case as in claim 1 and wherein upper side wall portions of said pouch are fabricated of a lining material for said carrying case.

* * * * *